US006546658B2

(12) United States Patent
Pitcher et al.

(10) Patent No.: US 6,546,658 B2
(45) Date of Patent: Apr. 15, 2003

(54) ELONGATED SHELL AND INTERNAL GRIPPER ASSEMBLY

(75) Inventors: David E. Pitcher, Cambridge, MA (US); Thomas P. Burrous, Andover, MA (US)

(73) Assignee: Rose Displays, Ltd., Salem, MA (US)

( * ) Notice: Subject to any disclaimer, the term of this patent is extended or adjusted under 35 U.S.C. 154(b) by 27 days.

(21) Appl. No.: 09/753,694

(22) Filed: Jan. 3, 2001

(65) Prior Publication Data

US 2001/0018784 A1 Sep. 6, 2001

Related U.S. Application Data

(63) Continuation-in-part of application No. 09/516,293, filed on Mar. 1, 2000, now abandoned.

(51) Int. Cl.[7] ..... G09F 3/20

(52) U.S. Cl. ..... 40/658; 40/611; 24/489; 24/498

(58) Field of Search ..... 40/575, 603, 604, 40/611, 617, 658, 666, 790; 248/229.1, 316.1, 316.7, 489; 24/489, 498, 516

(56) References Cited

U.S. PATENT DOCUMENTS 2,979,842 A * 4/1961 De Ridder ..... 40/743
3,643,362 A * 2/1972 Hackett et al. ..... 40/792
3,896,526 A * 7/1975 Joiner ..... 24/516 X
4,327,514 A * 5/1982 Bourque ..... 40/617 X
4,564,165 A * 1/1986 Grant et al. ..... 248/343
5,584,461 A * 12/1996 Pynenburg ..... 24/498 X
5,718,402 A * 2/1998 Hoffman et al. ..... 40/656 X
5,863,019 A * 1/1999 Rose et al. ..... 40/658 X

* cited by examiner

*Primary Examiner*—Brian K. Green
(74) *Attorney, Agent, or Firm*—Don Halgren

(57) ABSTRACT

An elongated shell and internal gripper assembly for gripping and supporting sheet-like posters or pictures for display purposes in a readily exchangeable manner. The assembly comprises an elongated, extruded gripper clip has a planar backing base pivotable distal-most poster receiving edge. The assembly includes an elongated, extruded receiving shell with a gripper clip receiving channel centrally arranged therein and an edge slot at a lowermost portion of the shell members. The gripper clip is slidably received within the receiving channel. The gripper clip has its distalmost receiving edge extending distally beyond the edge slot of the shell to permit display and exchange of a poster or picture therefrom.

6 Claims, 2 Drawing Sheets

ELONGATED SHELL AND INTERNAL GRIPPER ASSEMBLY

This application is a continuation-in-application of my copending U.S. patent application Ser. No. 09/516,293, filed Mar. 1, 2000, now abandoned, and is incorporated herein by reference in its entirety.

BACKGROUND OF THE INVENTION

1. Field of the Invention

This invention relates to gripping devices for securing one or more posters or signs and for holding together multiple sheets of papers or the like.

2. Prior Art

Posters and signs are required advertising in the commercial establishments such as stores and shops. These signs are of necessity supported in the most visible and presentable method possible. It is also most highly desired, to be able to adapt these signs or change them as the need arises. This is often fairly frequently in modem commercial establishments. To this end, they have been proposed a number of sign gripping components for such purposes.

U.S. Pat. No. 4,512,094 to Seely teaches a biasing means be integrally attached to both a cover and backing members for a frame support. The biasing means required of this patent are made of an extruded plastic material formed at the time of extrusion of the cover and backing members.

U.S. Pat. No. 4,512,095 to Seely shows a frame support with a biasing means which is integrally attached to a base member and a cover member, and the biasing means is co-extruded from a plastic at the same time as the base member and the cover member.

U.S. Pat. No. 4,519,152 to Seely et al. is directed to a tamper proof poster display with three frame surfaces of this complicated display having included angles of greater than 90 degrees therebetween.

U.S. Pat. No. 4,523,400 to Seely covers a plastic biased poster frame assembly. A biasing means is integrally attached to both a base member and a cover member, and the biasing means is formed by extrusion together with the base and cover members simultaneously.

U.S. Pat. No. 4,580,361 to Hillstrom et al. covers a display tensioning frame arrangement. A slide means in a base member, a tensioning means to tension the sign panel automatically when the sign is in position, or a clamp and spring arrangement for tensioning the sign or poster within the frame assembly is shown which complicates this device.

U.S. Pat. No. 4,937,959 to Palmer et al. covers a poster display device with a complicated longitudinal retention arrangement therewith. It teaches the use of a laterally protruding discontinuity and a laterally recessed portion formed in a front or back member to provide an interlocking interference.

U.S. Pat. No. 5,307,575 to Ivansson et al. relates to a framed corner assembly for posters. It teaches the use of an insert member or corner member with a rail hinge means, a gap means with an interference fit, and means to prevent sliding longitudinal movement of cover members.

U.S. Pat. No. 5,732,496 to Tanaka covers a sign frame arrangement with improved corner devices. It teaches using complicated corner members having a generally quadrant-shape and frame sections amongst other limitations, with the side surfaces and raised ridge members.

It is an object of the present invention to produce a sign gripping arrangement which includes the prior art.

It is a further object of the present invention, to provide a sign gripping arrangement which is literally changeable by a commercial store clerk with minimum training.

It is a further object of the present invention to provide a gripping apparatus which permits sign insertion and rigidity with minimal complexity.

BRIEF SUMMARY OF THE INVENTION

The present invention comprises an internal elongated extruded clip formed of a plastic material which is adapted and supported within an externally disposed elongated shell of extruded aluminum or the like. The elongated extruded clip comprises a generally linear, elongated backing base having a first or distalmost edge and a second or proximal edge defining a back plane. An elongated planar front member is disposed in a spaced apart parallel relationship to the planar backing base and is attached thereto by a bridge portion co-extruded therewith so as to hold the planar back base portion and the planar front member in a parallel and spaced apart manner.

An elongated support portion of T-shape in cross section has a leg which is unitary with the bridging portion of the extruded clip. The planar front member has an elongated distalmost edge which connects a pivotable first leg and second leg via a living hinge attached therebetween. The first leg and the second leg attached to the distalmost edge of the planar front member, are disposed at an angle of about 90 degrees to one another. The second leg has a distalmost portion which is unitarily attached to an elongated curvilinear foot which extends distally of the first or distalmost edge of the planar backing base. The first and second legs and the extended foot are arranged so as to be arcuately pivotable about the distalmost edge of the planar first member at the living hinge disposed therebetween.

The elongated shell or external portion of the present invention is preferably extruded from aluminum, and has an elongated generally C-shaped first opposed wall and an elongated generally C-shaped second opposed wall. Each first and second opposed walls have an uppermost edge and a lowermost edge which are spaced apart from one another. The first and second opposed walls are held in that spaced apart orientation by a bridging portion unitarily spaced therebetween adjacent the first end of each opposed wall. A U-shaped channel is disposed on an inwardly directed side of the bridging portion of the elongated shell, the U-shaped channel being defined by two L-shaped members, each having a distalmost edge directed towards and spaced apart from one another.

An L-shaped guide flange is arranged on the internal side of the first opposed wall and on the internal side of the second opposed wall adjacent their respective second ends. Each L-shaped guide flange has a side portion which is parallel to and spaced apart from its corresponding guide flange on its opposite wall.

In the assembly of the present invention, the internal portion, that is the elongated extruded clip, is slidably inserted within the central portion of the elongated shell between the first opposed wall and the second opposed wall. The T-shaped support on the second end of the elongated extruded clip is arranged to be slidably received within the distalmost opposed edges of the U-shaped channel extending downwardly from the bridging portion which supportably separates the first opposed wall from the second opposed wall of the elongated shell. The first or distalmost edge and the first and second legs and extended foot of the elongated extruded clip are arranged to be disposed and supported between the lowermost opposed edges of the first opposed wall and the second opposed wall to permit the extruded extended foot on the distal edge of the second leg, to be pivoted around the living hinge so as to permit insertion of a poster or the like between the planar backing base and the planar front member of the elongated extruded clip supported within the elongated shell.

The invention thus comprises an elongated shell and internal gripper assembly for gripping and supporting sheet-like posters or pictures for display purposes in a readily exchangeable manner. The assembly comprises an elongated, extruded gripper clip having a planar backing base pivotable distal-most poster receiving edge; an elongated, extruded receiving shell having a gripper clip receiving channel centrally arranged therein and also having an edge slot, wherein the gripper clip is slidably received within the receiving channel. The gripper clip has a distal-most receiving edge extending distally beyond said edge slot of the shell to permit display and exchange of a poster or picture therefrom. The distalmost receiving edge extends beyond a distalmost edge of the planar-backing base. The extruded shell comprises a pair of opposed C-shaped shell portions held in a spaced-apart manner by a unitary bridging member. The bridging member is arranged adjacent a first end of the spaced-apart shell portions. A U-shaped channel is arranged in an internal side of the bridging member to function as the receiving channel for the elongated gripping clip.

The invention also comprises a method of exchangably gripping and releasably supporting a sheet-like poster for display purposes by a gripper assembly comprising the steps of: arranging a first elongated extruded gripper clip in an elongated slot of an elongated extruded receiving shell, the elongated gripper clip being pre-loaded with a first sheet-like poster therein; removing the pre-loaded elongated extruded gripper clip from the elongated extruded receiving shell; and inserting a second elongated extruded gripper clip in the elongated slot of the elongated extruded receiving shell, the second elongated gripper clip being pre-loaded with a further sheet-like poster therein for display of further poster in place of the first sheet-like poster. The method may include the steps of spreading an extended foot of said elongated gripper clip away from a backing portion of said elongated gripper clip to permit a sheet-like poster to be supportively pinched therebetween; securing the elongated gripper clip in the elongated extruded receiving shell by the sliding intermating of a "T" shaped support of the clip in an inverted "U" shaped channel in the elongated extruded receiving shell; and supporting the elongated extruded receiving shell on a receiving hanger, the receiving hanger mating in an elongated upper edge slot in the elongated extruded receiving shell.

BRIEF DESCRIPTION OF THE DRAWINGS

The objects and advantages of the present invention will become more apparent, when viewed in conjunction with the following drawings in which.

DESCRIPTION OF PREFERRED EMBODIMENTS

Figure 3:
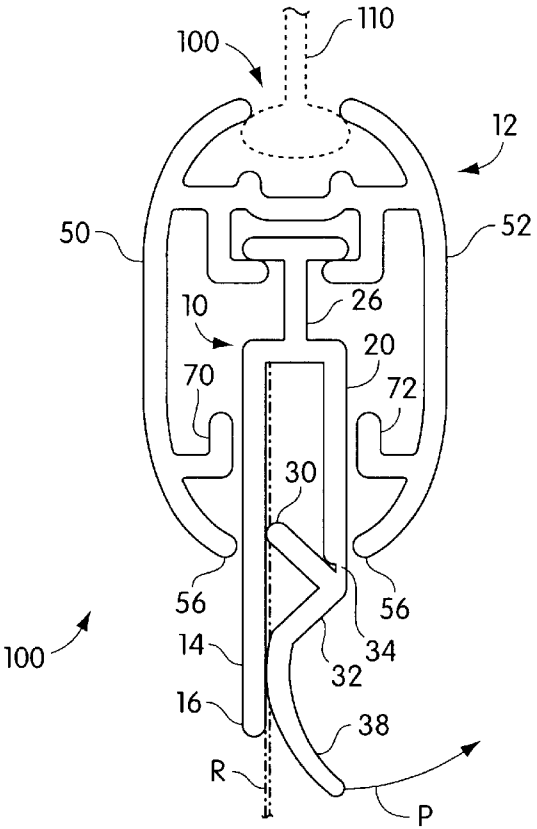
FIG. 3 is an end view of the elongated extruded clip disposed centrally within the elongated extruded shell.
Figure 2:
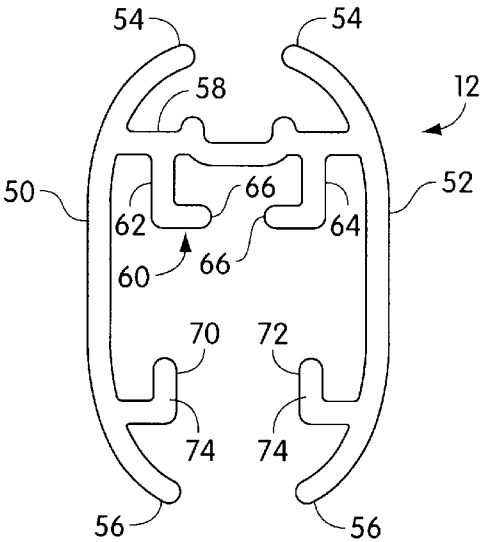
FIG. 2 is an end view of the elongated extruded shell of the present invention.
Figure 1:
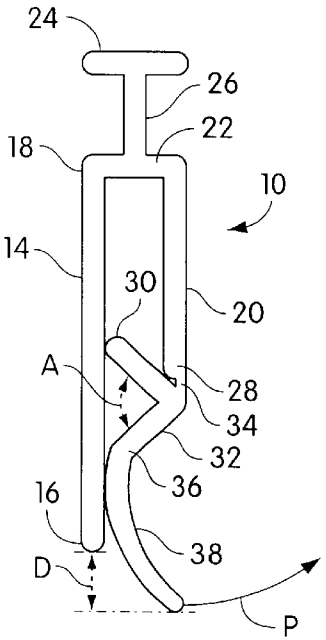
FIG. 1 is an end view of the elongated extruded clip of the present invention.

Referring now to the drawings in detail, and particularly to FIGS. 1, 2 and 3, there is shown in end views, a portion of the present elongated shell and internal gripper assembly 100 comprising an internal elongated extruded clip 10 formed of a plastic material which is adapted and supported within an externally disposed elongated shell 12 of extruded aluminum or the like. The elongated extruded clip 10 comprises a generally linear, elongated backing base 14 having a first or distalmost edge 16 and a second or proximal edge 18 defining a back plane. An elongated planar front member 20 is disposed in a spaced apart parallel relationship to the planar backing base 14 and is attached thereto by a bridge portion 22 co-extruded therewith so as to hold the planar back base portion 14 and the planar front member 20 in a parallel and spaced apart manner.

An elongated support portion 24 of T-shape in cross section has a leg 26 which is unitary with the bridging portion 22 of the extruded clip 10. The planar front member 20 has an elongated distalmost edge 28 which connects a pivotable first leg 30 and second leg 32 via a living hinge 34 attached therebetween. The first leg 30 and the second leg 32 attached to the distalmost edge 28 of the planar front member 20, are disposed at an angle "A" of about 90 degrees to one another. The second leg 32 has a distalmost portion 36 which is unitarily attached to an elongated curvilinear foot 38 which extends distally of the first or distalmost edge 16 of the planar backing base 14 by a distance "D". The first and second legs 30 and 32 and the extended foot 38 are arranged so as to be arcuately pivotable in an arc "P" about the distalmost edge 28 of the planar first member 20 at the living hinge 34 disposed therebetween.

The elongated shell 12 or external portion of the elongated shell and internal gripper assembly 100 of the present invention is preferably extruded from aluminum, and has an elongated generally C-shaped first opposed wall 50 and an elongated generally C-shaped second opposed wall 52. Each first and second opposed walls 50 and 52 have an uppermost edge 54 and a lowermost edge 56 which are spaced apart from one another. The first and second opposed walls are held in that spaced-apart "mirror-image" orientation by a bridging portion 58 unitarily spaced therebetween adjacent the first end 54 of each opposed wall 50 and 52. A U-shaped channel 60 is disposed on an inwardly directed side of the bridging portion 58 of the elongated shell 50 and 52, as shown in FIG. 2, the U-shaped channel 60 being defined by two opposed, spaced-apart "mirror-image" oriented L-shaped members 62 and 64, each having a distalmost edge 66 directed towards and spaced apart from one another.

An L-shaped guide flange 70 is arranged on the internal side of the first opposed wall 50 and an L-shaped flange 72 is arranged on the internal side of the second opposed wall 52 adjacent their respective second ends 56. Each L-shaped guide flange 70 and 72 has a side portion 74 which is parallel to and spaced apart from its corresponding guide flange 70 or 72 on its opposite wall 50 or 52.

In the assembly of the elongated shell and internal gripper assembly 100 as shown in FIG. 3, the internal portion, that is the elongated extruded clip 10, is slidably inserted within the central portion of the elongated shell 12 between the first opposed wall 50 and the second opposed wall 52. The T-shaped support 24 on the second end of the elongated extruded clip 10 is arranged to be slidably received within the distalmost opposed edges 66 of the U-shaped channel 60 extending downwardly from the bridging portion 58 which supportably separates the first opposed wall 50 from the second opposed wall 52 of the elongated shell 12. The first or distalmost edge 16 and the first and second legs 30 and 32 and extended foot 38 of the elongated extruded clip 10 are arranged to be disposed and supported between the lowermost opposed edges 56 of the first opposed wall 50 and the second opposed wall 52 to permit the extruded extended foot 38 on the distal edge 28 of the second leg 32, to be pivoted around the living hinge so as to permit insertion of a poster "R" or the like between the planar backing base 14 and the planar front member 20 of the elongated extruded clip 10 supported within the elongated shell 12.

The elongated shell and internal gripper assembly 100 may be arranged in a linear manner and supported by an overhead support 110, such as one or more flexible wires or a rigid hanger. Alternatively, a plurality of elongated shell and internal gripper assemblies 100 may have mitered ends and be assembled as a poster or picture frame with the elongated foot portion 38 facing toward the viewer to permit easy and rapid exchange or posters or pictures therewithin.

Figure 6:
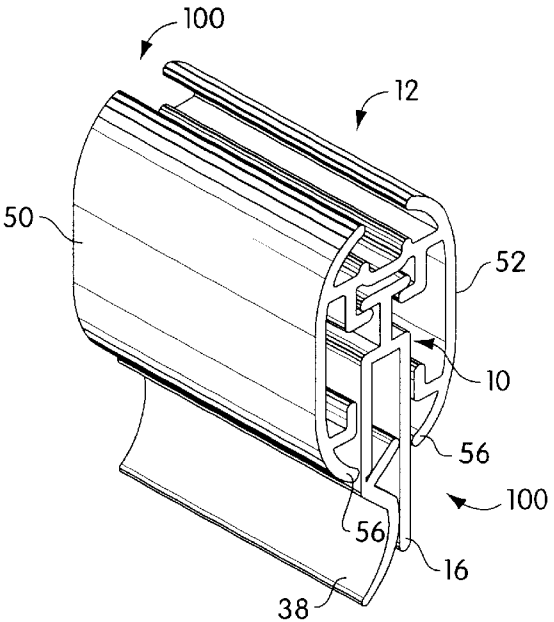
FIG. 6 is a perspective view of the assembly of the elongated extruded clip and the elongated extruded shell shown in FIG. 3.
Figure 5:
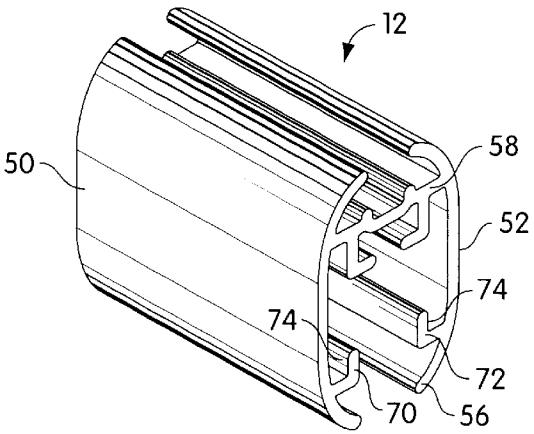
FIG. 5 is a perspective view of the elongated extruded shell shown in FIG. 2.
Figure 4:
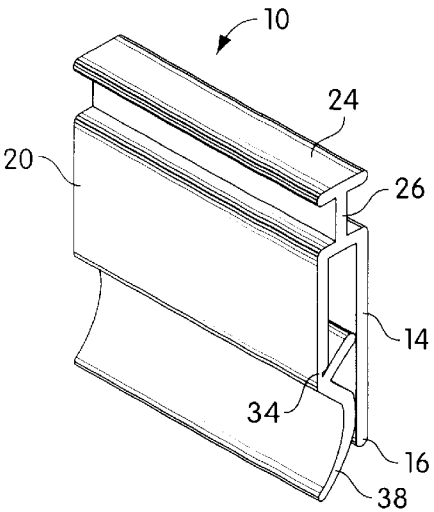
FIG. 4 is a perspective view of the elongated extruded clip shown in FIG. 1.

FIG. 4 shows the extruded clip 10 in a perspective orientation with its extended foot 38 extending beyond the distalmost edge of the planar backing base 14. The elongated extruded external shell 12 is shown in a perspective view in FIG. 5 and the entire elongated shell and internal gripper assembly 100 is shown assembled together in perspective in FIG. 6. It may be seen that the internal clip 10 may be readily removed from the external shell 12 for exchange of a poster, picture or the like, or that the extended foot 38 may be readily pivoted about its hinge 34 to permit a poster or picture to be exchanged therein while that clip 10 remains within the elongated shell 12.

We claim:

1. An elongated shell and internal gripper assembly for gripping and supporting sheet-like posters or pictures for display purposes in a readily exchangeable manner, said assembly comprising:

an elongated extruded pinching gripper clip having a planar backing base and a pivotable distal-most poster receiving foot so as to grippably pinch a poster between said planar backing base and said pivotable foot;

an elongated, extruded receiving shell having a gripper clip receiving channel centrally arranged therein and also having an edge slot, wherein said pinching gripper clip is slidably received within said receiving channel, said gripper clip having said pivotable distalmost receiving foot pressing against said backing base and extending distally beyond said edge slot of said shell to permit display and exchange of a poster or picture therefrom.

2. The elongated shell and internal gripper assembly as recited in claim 1, wherein said distalmost receiving foot extends beyond a distalmost edge of said planar backing base.

3. The elongated shell and internal gripper assembly as recited in claim 1, wherein said extruded shell comprises a pair of opposed C-shaped shell portions held in a spaced-apart manner by a unitary bridging member.

4. The elongated shell and internal gripper assembly as recited in claim 3, wherein said bridging member is arranged adjacent a first end of said spaced-apart shell portions.

5. The elongated shell and internal gripper assembly as recited in claim 4, including a U-shaped channel arranged in an internal side of said bridging member to function as said receiving channel for said elongated gripping clip.

6. An elongated shell and internal gripper assembly for pinchably gripping and supporting sheet-like posters or pictures for display purposes in a readily exchangeable manner, said assembly comprising:

an elongated, extruded pinching gripper-clip having a planar backing base and a pivotable distalmost poster receiving foot so as to grippably pinch a poster between said planar backing base and said pivotable foot;

an elongated, extruded receiving shell having a gripper clip receiving channel centrally arranged therein and also having an edge slot, wherein said pinching gripper clip is slidably received within said receiving channel, said gripper clip having said pivotable distalmost receiving foot extending distally beyond said edge slot of said shell to permit display and pivoting of said foot to also permit exchange of a poster or picture therefrom, wherein said distalmost receiving foot extends beyond a distalmost edge of said planar backing base; and wherein said extruded shell comprises a pair of opposed C-shaped shell portions held in a spaced-apart manner by a unitary bridging member.

* * * * *